US009695631B2

(12) United States Patent
Huang

(10) Patent No.: US 9,695,631 B2
(45) Date of Patent: Jul. 4, 2017

(54) BUILT-IN-BLIND ASSEMBLY

(71) Applicant: Shanghai Kingshine Plastic Manufacture Co., Ltd., Shanghai (CN)

(72) Inventor: Szu-Chang Huang, Shanghai (CN)

(73) Assignee: SHANGHAI KINGSHINE PLASTIC MANUFACTURE CO., LTD., Shanghai (CN)

( * ) Notice: Subject to any disclaimer, the term of this patent is extended or adjusted under 35 U.S.C. 154(b) by 0 days.

(21) Appl. No.: 15/004,274

(22) Filed: Jan. 22, 2016

(65) Prior Publication Data

US 2016/0340974 A1 Nov. 24, 2016

(30) Foreign Application Priority Data

May 19, 2015 (CN) ..... 2015 2 0325092 U

(51) Int. Cl.
*E06B 9/264* (2006.01)
*E06B 9/327* (2006.01)
*E06B 9/323* (2006.01)

(52) U.S. Cl.
CPC ..... *E06B 9/264* (2013.01); *E06B 9/323* (2013.01); *E06B 9/327* (2013.01); *E06B 2009/2643* (2013.01)

(58) Field of Classification Search
CPC ..... E06B 9/264; E06B 2009/2643; E06B 2009/2646; E06B 9/17015; E06B 9/17023
USPC ..... 160/107, 98, 173 R
See application file for complete search history.

(56) References Cited

U.S. PATENT DOCUMENTS 4,197,896 A * 4/1980 Reichstadt ..... E06B 9/17023 160/107
4,604,840 A * 8/1986 Mondon ..... E06B 1/6015 52/172
4,643,238 A * 2/1987 Tachikawa ..... E06B 9/307 160/168.1 R
5,699,845 A * 12/1997 Jelic ..... E06B 9/264 160/107
6,431,247 B1 * 8/2002 Harrison, Jr. ..... E06B 9/323 160/168.1 R
7,543,623 B2 * 6/2009 Allardyce ..... E06B 9/264 160/107
2007/0125504 A1 * 6/2007 Early ..... E06B 9/264 160/107

(Continued)

FOREIGN PATENT DOCUMENTS

CN 201474570 U 5/2010

*Primary Examiner* — David Purol
(74) *Attorney, Agent, or Firm* — Andrew F. Young, Esq.; Lackenbach Siegel, LLP

(57) ABSTRACT

A built-in blind assembly includes light-transmissive first and second outer panels, a blind unit, a frame unit, a top rail unit, and a cord-driving unit. The first and second outer panels face each other. The blind unit is disposed between the first and second outer panels. The frame unit includes a top frame disposed above the blind unit. The top rail unit includes a top rail seat that is connected to the top frame and that defines a top accommodating cavity having an open side adjacent to the second outer panel, and a top cover that is removably connected to the top rail seat. The cord-driving unit is disposed in the top accommodating cavity, is coupled to the blind unit, and is operable to control operation of the blind unit.

12 Claims, 6 Drawing Sheets

(56) References Cited

U.S. PATENT DOCUMENTS

| | | | | |
|---|---|---|---|---|
| 2008/0029226 | A1* | 2/2008 | Huang | E06B 9/264 160/107 |
| 2014/0020851 | A1* | 1/2014 | Ouzts | E06B 9/264 160/107 |
| 2014/0246155 | A1* | 9/2014 | Nicolosi | E06B 3/66309 160/107 |
| 2015/0292258 | A1* | 10/2015 | Pellini | E06B 3/66319 428/34 |

* cited by examiner

BUILT-IN-BLIND ASSEMBLY

CROSS-REFERENCE TO RELATED APPLICATION

This application claims priority of Chinese Patent Application No. 201520325092.0, filed on May 19, 2015, the entire contents of which are incorporated herein by reference.

FIELD

The disclosure relates to a blind assembly, more particularly to a built-in blind assembly.

BACKGROUND

Chinese Utility Model No. 201474570U discloses a conventional built-in blind assembly including front and rear panels, a blind unit disposed between the front and rear panels, opposite top and bottom frames disposed respectively above and below the blind unit and between the front and rear panels, and a U-shaped top rail seat removably coupled to the top frame and cooperating with the top frame to define an accommodating cavity for receiving a cord-driving unit therein. However, since an open side of the accommodating cavity faces upwardly toward the top frame, and since the top rail seat is coupled to the top frame, it is not possible for a user to access the cord-driving unit in the accommodating space without decoupling the top frame and the top rail seat first. Moreover, when assembling the conventional blind assembly, vision of the user may be blocked by the top rail seat, thereby resulting in a relatively low assembling efficiency.

SUMMARY

Therefore, an object of the disclosure is to provide a built-in blind assembly that can alleviate at least one the drawbacks of the prior art.

According to the disclosure, a built-in blind assembly includes light-transmissive first and second outer panels, a blind unit, a frame unit, a top rail unit and a cord-driving unit.

The first and second outer panels are spaced apart from and face each other in a front-rear direction.

The blind unit is disposed between the first and second outer panels.

The frame unit is disposed between the first and second outer panels and includes a top frame disposed above the blind unit.

The top rail unit is disposed between the first and second panels and between the top frame and the blind unit. The top rail unit includes a top rail seat that is removably connected to the top frame and that defines a top accommodating cavity having an open side adjacent to the second outer panel, and a top cover that is removably connected to the top rail seat for covering and uncovering the open side of the top accommodating cavity.

The cord-driving unit is disposed in the top accommodating cavity, is coupled to the blind unit, and is operable to control operation of the blind unit.

BRIEF DESCRIPTION OF THE DRAWINGS

Other features and advantages of the disclosure will become apparent in the following detailed description of an embodiment with reference to the accompanying drawings, of which.

DETAILED DESCRIPTION

Figure 1:
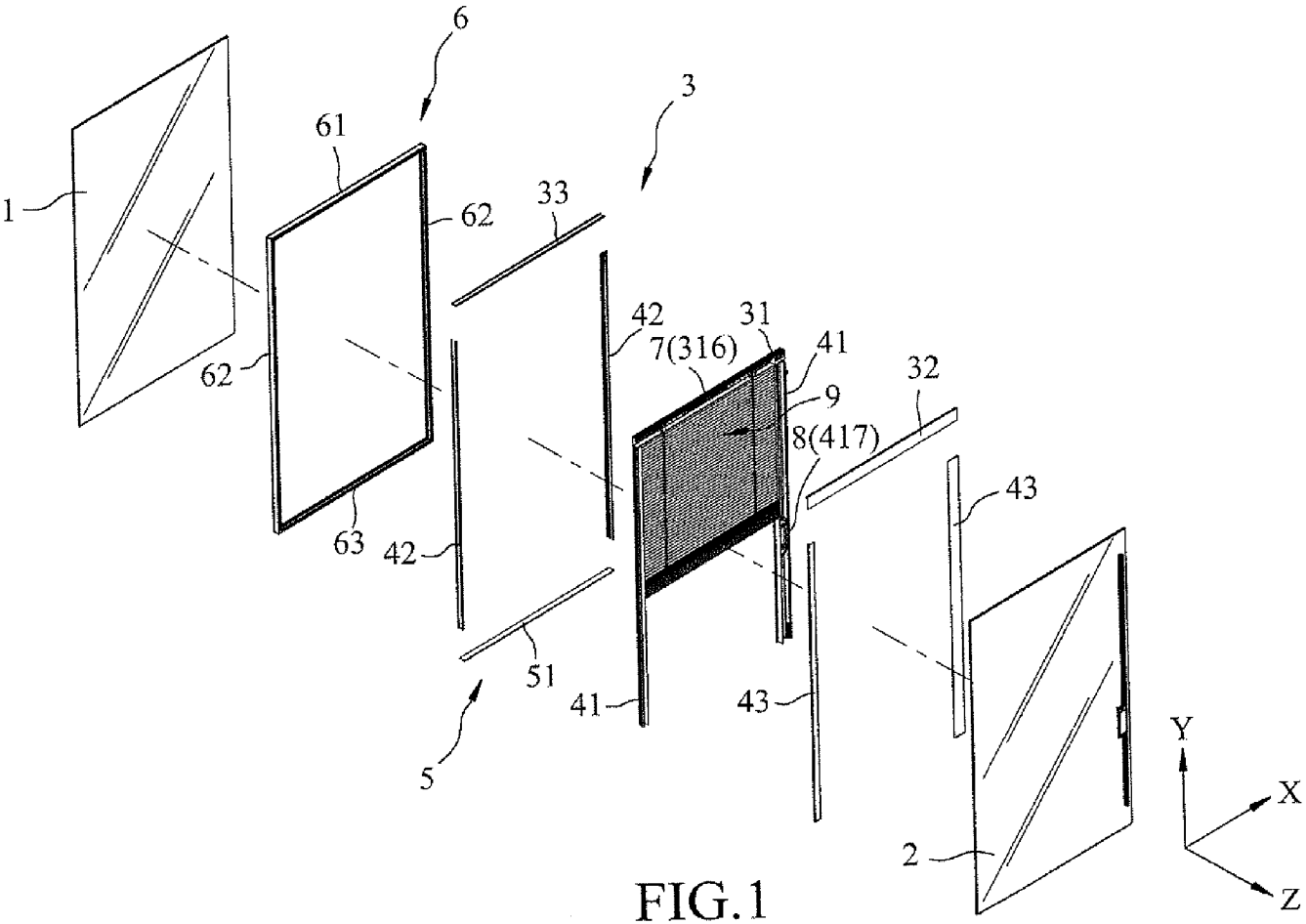
FIG. 1 is an exploded perspective view illustrating an exemplary embodiment of a built-in blind assembly according to the disclosure.

Referring to FIGS. 1 to 6, the exemplary embodiment of a built-in blind assembly according to the present disclosure is shown to include first and second outer panels 1, 2, a top rail unit 3, a pair of side rail units 4, a bottom rail unit 5, a frame unit 6, a cord-driving unit 7, a control unit 8 and a blind unit 9. The blind assembly is configured for application to a window in this embodiment, but may be configured differently, such as for application to a door, in other embodiments.

The first and second outer panels 1, 2, which are light-transmissive, are spaced apart from and face each other in a front-rear direction (Z).

The blind unit 9 is disposed between the first and second outer panels 1, 2 and includes a blind member that is disposed between the top and bottom rail units 4 and 5. The blind unit 9 of this embodiment may be configured as, but is not limited to, pleated shades or cellular shades.

As shown in FIG. 1, the frame unit 6 is disposed between the first and second outer panels 1, 2 and includes a top frame 61 that is disposed above the blind unit 9, a bottom frame 63 that is disposed below the blind unit 9, and a pair of side frames 62 that extend in a top-bottom direction (Y), that are disposed at opposite lateral sides of the blind unit 9 (see FIG. 4) and that interconnect the top and bottom frames 61, 63.

Figure 3:
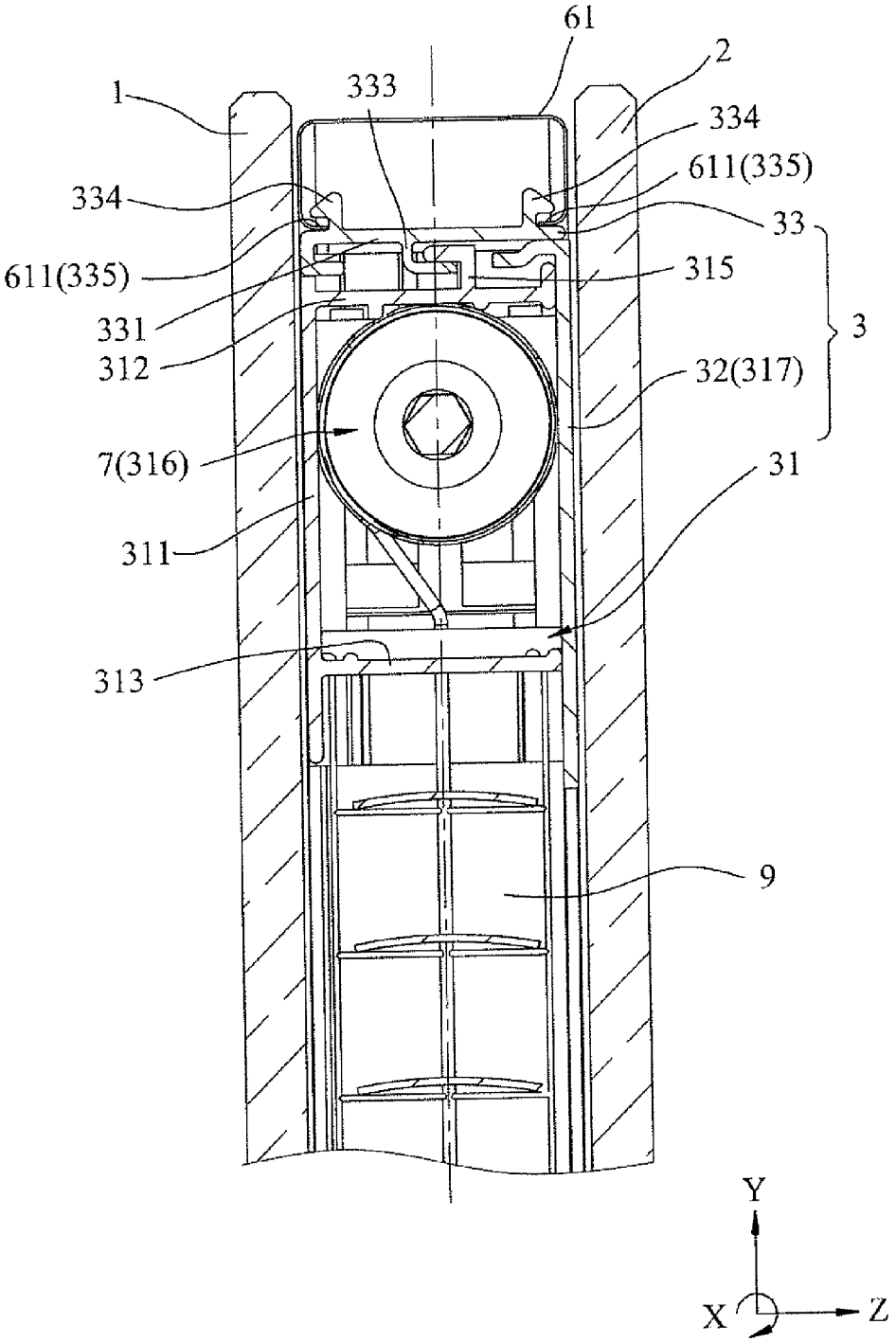
FIG. 3 is a fragmentary sectional view of the exemplary embodiment which is taken along line of FIG. 2.

As shown in FIG. 3, the top rail unit 3 is disposed between the first and second outer panels 1, 2 and between the top frame 61 and the blind unit 9. In this embodiment, the top rail unit 3 includes a top rail seat 31, a top cover 32, and a top connecting seat 33.

Figure 6:
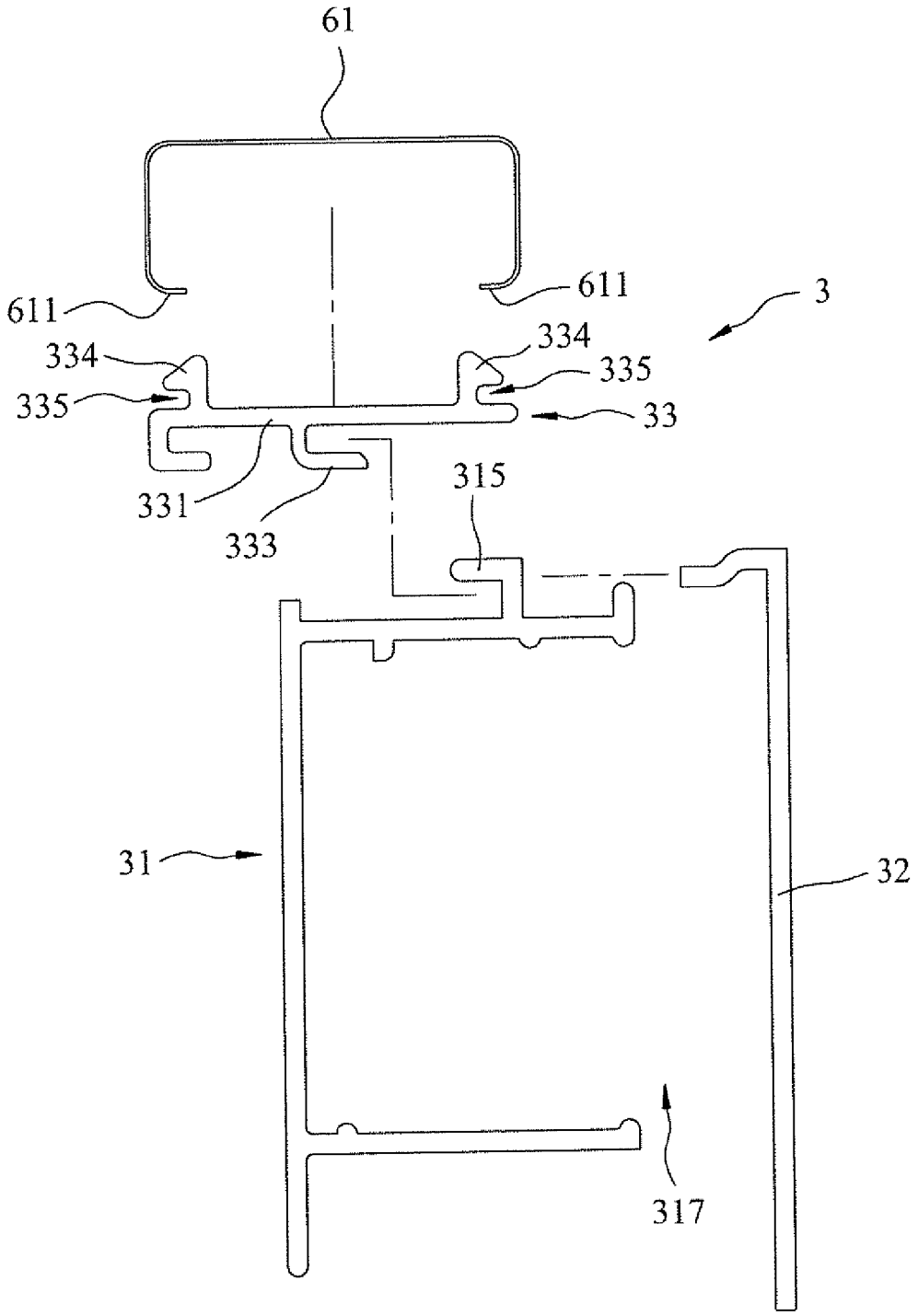
FIG. 6 is a schematic exploded side view of the exemplary embodiment, illustrating a top frame, a top connecting seat and a top rail unit of the built-in blind assembly.

The top rail seat 31 is removably connected to the top frame 61 through the top connecting seat 33 and defines a top accommodating cavity 316 having an open side 317 adjacent to the second outer panel 2 (see FIGS. 3 and 6). In greater detail, as shown in FIGS. 3 and 6, the top rail seat 31 has a base wall 311 and first and second compartment walls 312, 313. The base wall 311 is disposed adjacent to the first outer panel 1 and extends longitudinally in a left-right direction (X) and between the top frame 61 and the blind unit 9. The first compartment wall 312 extends from a top end of the base wall 311 toward the second outer panel 2. The second compartment wall 313 extends from a bottom end of the base wall 311 toward the second outer panel 2 and cooperates with the base wall 311 and the first compartment wall 312 to define the top accommodating cavity 316. As shown in FIG. 3, the cord-driving unit 7 is disposed in the top accommodating cavity 316. The cord-driving unit 7 is coupled to the blind unit 9 and is operable to control operation of the blind unit 9. Since the feature of the blind assembly does not reside in the specific configuration of the cord-driving unit 7, which may be readily appreciated by those skilled in the art, further details of the same are omitted herein for the sake of brevity.

The top cover 32 longitudinally extends in the left-right direction (X) and is removably connected to the top rail seat 31 for covering and uncovering the open side 317 of the top accommodating cavity 316 of the top rail seat 31.

The top connecting seat 33 interconnects the top frame 61 and the top rail seat 31, and has a main portion 331 longitudinally extending in the left-right direction (X). As shown in FIGS. 3 and 6, the first compartment wall 312 of the top rail seat 31 has an engaging segment 315 extending toward the top frame 61 of the frame unit 6, and the top connecting seat 33 further has an engaging portion 333 that is formed on the main portion 331 and that removably engages the engaging segment 315 of the first compartment wall 312 of the top rail seat 31. In this embodiment, the engaging segment 315 of the first compartment wall 312 and the engaging portion 333 of the top connecting seat 33 are configured as interlocking hook structures, but the disclosure should not be limited in this respect.

It should be noted that, in this embodiment, the top connecting seat 33 has a pair of positioning structures 334 that project away from the blind unit 9 and that are spaced apart from each other in the front-rear direction (Z) as illustrated in FIG. 3. Each of the positioning structures 334 defines a positioning groove 335 that opens toward an adjacent one of the first and second outer panels 1, 2. The top frame 61 of the frame unit 6 has a pair of positioning segments 611 each longitudinally extending in the left-right direction (X) and each releasably interlocking with a respective one of the positioning structures 334 at the positioning groove 335 as best shown in FIG. 3.

Figure 2:
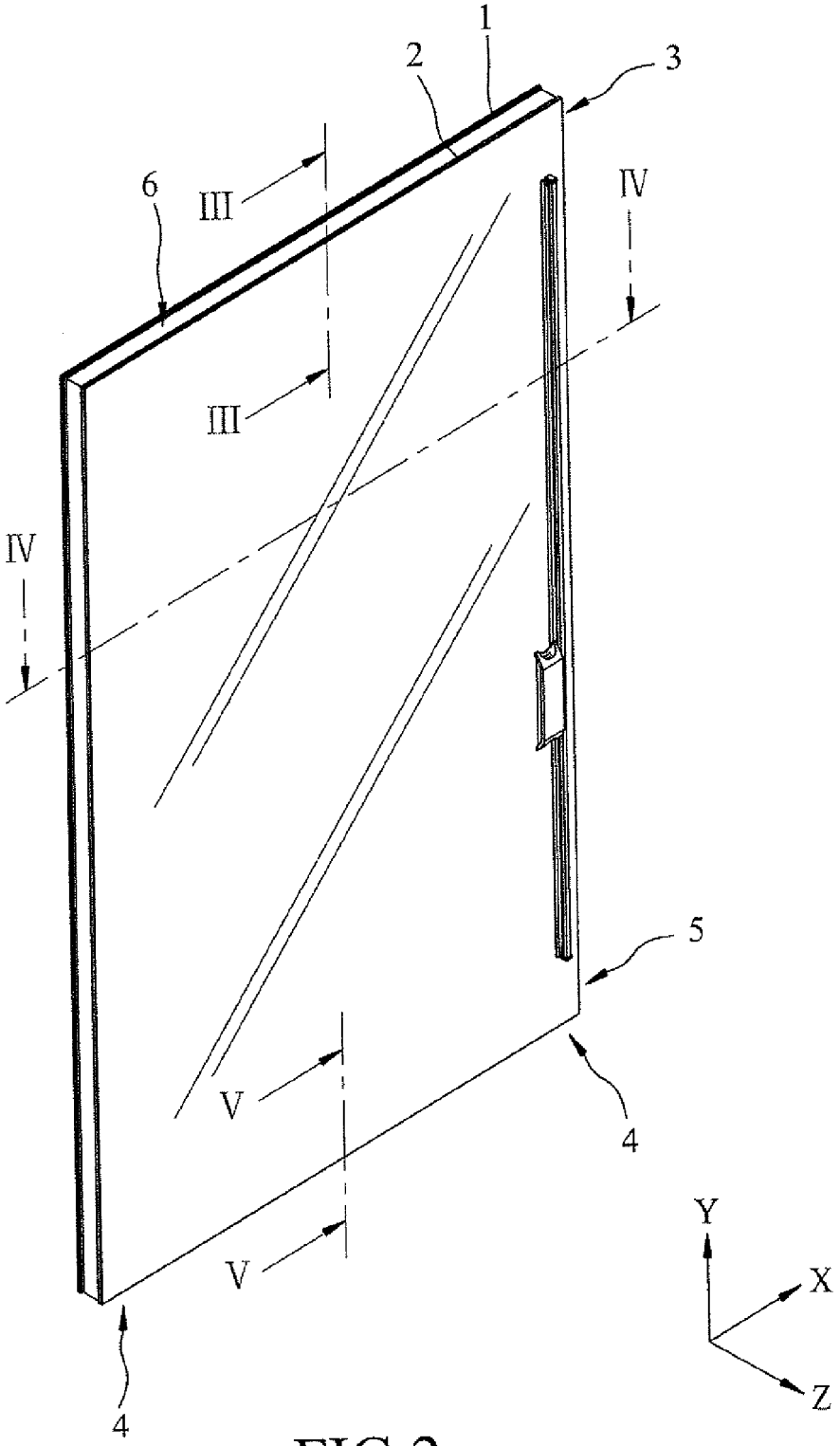
FIG. 2 is an assembled perspective view of the exemplary embodiment.
Figure 4:
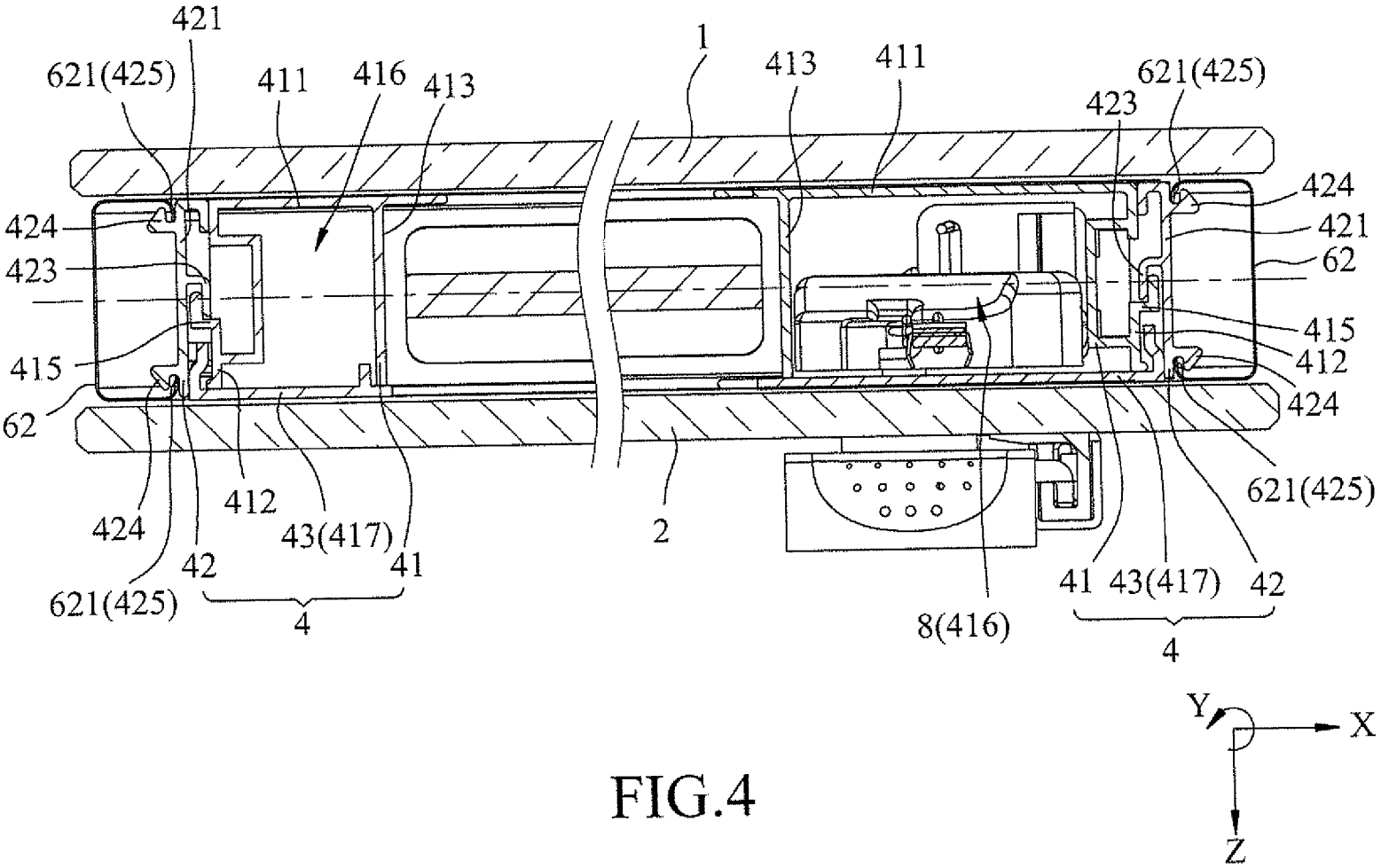
FIG. 4 is a fragmentary sectional view of the exemplary embodiment which is taken along line IV-IV of FIG. 2.

As shown in FIGS. 1, 2 and 4, each of the side rail units 4 is disposed between the first and second outer panels 1, 2 and between the blind unit 9 and a respective one of the side frames 62. Each of the side rail units 4 includes a side rail seat 41, a side connecting seat 42 and a side cover 43.

The side rail seat 41 is removably connected to the respective one of the side frames 62 through the side connecting seat 42 and defines a side accommodating cavity 416 having an open side 417 adjacent to the second outer panel 2. In greater detail, the side rail seat 41 of each of the side rail units 4 has a side wall 411 and first and second compartment walls 412, 413. The side wall 411 is disposed adjacent to the first outer panel 1 and extends longitudinally in the top-bottom direction (Y) and between the blind unit 9 and the respective one of the side frames 62. The first and second compartment walls 412, 413 of the side rail seat 41 respectively extend from opposite lateral ends of the side wall 411 toward the second outer panel 2 in the front-rear direction (Z). The side wall 411 and the first and second compartment walls 412, 413 cooperatively define the side accommodating cavity 416. As shown in FIG. 4, the control unit 8 is disposed in the side accommodating cavity 416 of the side rail seat 41 of one of the side rail units 4. The control unit 8 is coupled to the cord-driving unit 7 and is operable to control operation of the cord-driving unit 7 and the blind unit 9. Since the feature of the blind assembly does not reside in the specific configuration of the control unit 8, which may be readily appreciated by those skilled in the art, further details of the same are omitted herein for the sake of brevity.

The side connecting seat 42 interconnects the first compartment wall 412 of the side rail seat 41 and the respective one of the side frames 62, and has a main portion 421 extending longitudinally in the top-bottom direction (Y). As shown in FIG. 4, for each of the side rail units 4, the first compartment wall 412 of the side rail seat 41 has an engaging segment 415 extending toward the respective one of the side frames 62, and the side connecting seat 42 has an engaging portion 423 that is formed on the main portion 421 and that removably engages the engaging segment 415 of the first compartment wall 412. In this embodiment, the engaging segment 415 of the first compartment wall 412 and the engaging portion 423 of the side connecting seat 42 are configured as interlocking hook structures, but the disclosure should not be limited in this respect.

The side cover 43 extends longitudinally in the top-bottom direction (Y) and is removably connected to the side rail seat 41 for covering and uncovering the open side 417 of the side accommodating cavity 416.

In this embodiment, for each of the side rail units 4, the side connecting seat 42 has a pair of positioning structures 424 that project away from the blind unit 9 and that are spaced apart from each other in the front-rear direction (Z). Each of the positioning structures 424 defines a positioning groove 425 that opens toward an adjacent one of the first and second outer panels 1, 2. Each of the side frames 62 has a pair of positioning segments 621 each extending longitudinally in the top-bottom direction (Y) and each releasably interlocking with a respective one of the positioning structures 424 of the side connecting seat 42 of the respective one of the side rail units 4 at the positioning groove 425 as best shown in FIG. 4.

Figure 5:
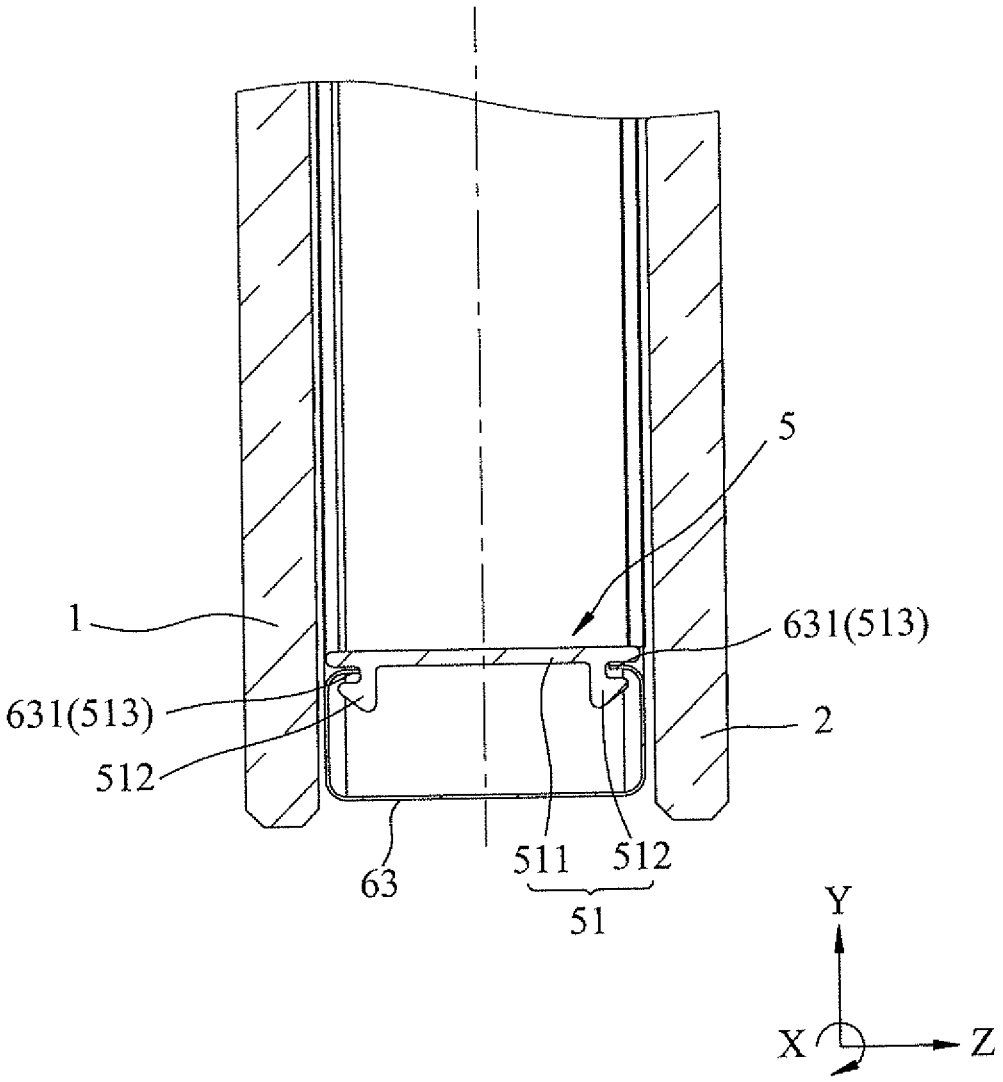
FIG. 5 is a fragmentary sectional view of the exemplary embodiment which is taken along line V-V of FIG. 2.

As shown in FIGS. 1 and 5, the bottom rail unit 5 includes a bottom connecting seat 51 that is disposed between the first and second outer panels 1, 2 and between the blind unit 9 and the bottom frame 63 for supporting the blind unit 9. The bottom connecting seat 51 has a main portion 511 extending longitudinally in the left-right direction (X) and a pair of positioning structures 512 that are formed on the main portion 511, that project away from the blind unit 9 and that are spaced apart from each other in the front-rear direction (Z). Each of the positioning structures 512 defines a positioning groove 513 that opens toward an adjacent one of the first and second outer panels 1, 2. The bottom frame 63 has a pair of positioning segments 631 each extending longitudinally in the left-right direction (X) and each releasably interlocking with a respective one of the positioning structures 512 at the positioning groove 513.

When assembling the built-in blind assembly of the present disclosure, the top connecting seat 33 is first coupled to the top frame 61 by interlocking the positioning structures 334 of the top connecting seat 33 with the positioning segments 611 of the top frame 61, followed by coupling the top rail seat 31 to the top connecting seat 33 by interlocking the engaging segment 315 of the top rail seat 31 with the engaging portion 333 of the top connecting seat 33. After the cord-driving unit 7 is installed in the top accommodating cavity 316 via the open side 317, the top cover 32 can be placed to cover the open side 317 of the top accommodating cavity 316. The side frames 62 and the side rail units 4 are assembled together in a manner similar to that of the top frame 61 and the top rail unit 3. After installing the control unit 8 in the side accommodating cavity 416 of one of the side rail units 41 via the open side 417, the side cover 43 of said one of the side rail units 4 is placed to cover the open side 417. The bottom frame 63 and the bottom rail unit 5 are then assembled. Subsequently, after the top frame 61, the bottom frame 63 and the side frames 62 are assembled together with the blind unit 9, the first and second outer panels 1, 2 are then connected to the frame unit 6 using a sealant.

The built-in blind assembly of the present disclosure is advantageous in the following aspects:

1. The open side 317 of the top accommodating cavity 316 and the open side 417 of the side accommodating cavity 416 are disposed adjacent to and face the second outer panel 2, thereby allowing a user to install the cord-driving unit 7 and the control unit 8 from one side of the built-in blind assembly, so as to improve assembling efficiency thereof.

2. Since the open side 317 of the top accommodating cavity 316 and the open side 417 of the side accommodating cavity 416 face the second outer panel 2, vision of the user will not be blocked by the top and side rail seats 3, 4 of the built-in blind assembly, so as to further improve the assembling accuracy and efficiency.

3. The interlocking configurations between the top rail unit 3 and the top frame 61, between the side frame units 4 and the side frames 62, and between the bottom rail unit 5 and the bottom frame 63 do not require additional fasteners, such as screws and bolts, and thus reduce the production cost of the built-in blind assembly according to the present disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A built-in blind assembly, comprising:

light-transmissive first and second outer panels spaced apart from and facing each other in a front-rear direction;

a blind unit disposed between said first and second outer panels;

a frame unit disposed between said first and second outer panels and including a top frame disposed above said blind unit;

a top rail unit disposed between said first and second outer panels and between said top frame and said blind unit, said top rail unit including a top rail seat that is removably connected to said top frame and that defines a top accommodating cavity having an open side adjacent to said second outer panel, and a top cover that is removably connected to said top rail seat for covering and uncovering said open side of said top accommodating cavity; and a cord-driving unit that is disposed in said top accommodating cavity, that is coupled to said blind unit, and that is operable to control operation of said blind unit;

wherein said top rail seat has a base wall that extends between said top frame and said blind unit and that is disposed adjacent to said first outer panel, a first compartment wall that extends from a top end of said base wall toward said second outer panel, and a second compartment wall that extends from a bottom end of said base wall toward said second outer panel, and that cooperates with said base wall and said first compartment wall to define said top accommodating cavity;

wherein said top rail unit further includes a top connecting seat that interconnects said top frame and said first compartment wall;

wherein said top connecting seat has a pair of positioning structures that project away from said blind unit and that are spaced apart from each other in the front-rear direction, each of said positioning structures defining a positioning groove that opens toward an adjacent one of said first and second outer panels; and wherein said top frame has a pair of positioning segments each releasably interlocking with a respective one of said positioning structures at said positioning groove.

2. The built-in blind assembly according to claim 1, wherein said first compartment wall has an engaging segment extending toward said top frame, and said top connecting seat has an engaging portion that removably engages said engaging segment of said first compartment wall.

3. The built-in blind assembly according to claim 2, wherein said engaging segment and said engaging portion are configured as interlocking hook structures.

4. The built-in blind assembly according to claim 1, wherein said frame unit further has a pair of side frames that extend in a top-bottom direction and that are disposed at opposite lateral sides of said blind unit, said built-in blind assembly further comprising:

a pair of side rail units disposed between said first and second outer panels and each disposed between said blind unit and a respective one of said side frames, each of said side rail units including a side rail seat that is removably connected to the respective one of said side frames and that defines a side accommodating cavity having an open side adjacent to said second outer panel; and a control unit that is disposed in said side accommodating cavity of said side rail seat of one of said side rail units, that is coupled to said cord-driving unit, and that is operable to control operation of said cord-driving unit and said blind unit.

5. The built-in blind assembly according to claim 4, wherein each of said side rail units further includes a side cover that is removably connected to said side rail seat for covering and uncovering said open side of said side accommodating cavity.

6. The built-in blind assembly according to claim 4, wherein said side rail seat of each of said side rail units has:

a side wall that extends between said blind unit and the respective one of said side frames and that is disposed adjacent to said first outer panel; and first and second compartment walls that respectively extend from opposite lateral ends of said side wall toward said second outer panel, said first and second compartment walls and said side wall cooperatively defining said side accommodating cavity.

7. The built-in blind assembly according to claim 6, wherein each of said side rail units further includes a side connecting seat that interconnects said first compartment wall and the respective one of said side frames.

8. The built-in blind assembly according to claim 7, wherein, for each of said side rail units, said first compartment wall has an engaging segment extending toward the respective one of said side frames, and said side connecting seat has an engaging portion that removably engages said engaging segment of said first compartment wall.

9. The built-in blind assembly according to claim 8, wherein:

for each of said side rail units, said side connecting seat has a pair of positioning structures that project away from said blind unit and that are spaced apart from each other in the front-rear direction, each of said positioning structures defining a positioning groove that opens toward an adjacent one of said first and second outer panels; and each of said side frames has a pair of positioning segments each releasably interlocking with a respective one of said positioning structures of said side connecting seat of the respective one of said side rail units at said positioning groove.

10. The built-in blind assembly according to claim 1, wherein said frame unit further includes a bottom frame that is disposed below said blind unit, said built-in blind assembly further comprising a bottom rail unit including a bottom connecting seat that is disposed between said first and second outer panels and between said blind unit and said bottom frame, and that is removably connected to said bottom frame for supporting said blind unit.

11. The built-in blind assembly according to claim 10, wherein:

said bottom connecting seat has a pair of positioning structures that project away from said blind unit and that are spaced apart from each other in the front-rear direction, each of said positioning structures defining a positioning groove that opens toward an adjacent one of said first and second outer panels; and said bottom frame has a pair of positioning segments each releasably interlocking with a respective one of said positioning structures at said positioning groove.

12. The built-in blind assembly according to claim 11, wherein said blind unit includes a blind member that is disposed between said top and bottom rail units.

* * * * *